United States Patent [19]

Ma

[11] Patent Number: 4,573,332

[45] Date of Patent: Mar. 4, 1986

[54] PORTABLE SECURITY BOX

[75] Inventor: Hansan Ma, Hoffman Estates, Ill.

[73] Assignee: Idesign, Inc., San Francisco, Calif.

[21] Appl. No.: 608,702

[22] Filed: May 10, 1984

[51] Int. Cl.[4] ..... E05B 65/52

[52] U.S. Cl. ..... 70/30; 70/63; 70/160; 70/332; 70/443; 70/445; 109/52

[58] Field of Search ..... 70/63, 159–169, 70/30, 49, 332, 443, 445, 53, 57, 58, 158, 233; 220/210, 315; 109/45, 50, 52

[56] References Cited

U.S. PATENT DOCUMENTS

| | | | |
|---|---|---|---|
| 3,125,873 | 3/1964 | Robinson | 70/63 |
| 3,568,902 | 3/1971 | Highberger | 70/58 X |
| 3,727,438 | 4/1973 | Knaack | 70/63 |
| 3,985,275 | 10/1976 | Allen | 70/58 X |
| 4,057,983 | 11/1977 | Morgan | 70/58 X |
| 4,070,879 | 1/1978 | Thompson | 70/49 X |
| 4,146,242 | 3/1979 | Bose | 70/58 X |
| 4,300,373 | 11/1981 | Camos et al. | 70/164 X |
| 4,462,317 | 7/1984 | Franko et al. | 70/63 X |
| 4,474,116 | 10/1984 | Castenada, Jr. et al. | 70/63 X |

FOREIGN PATENT DOCUMENTS

| | | | |
|---|---|---|---|
| 134247 | 9/1949 | Australia | 220/210 |
| 869255 | 4/1971 | Canada | 70/58 |
| 987121 | 4/1976 | Canada | 70/58 |
| 2556352 | 6/1977 | Fed. Rep. of Germany | 70/58 |
| 889179 | 5/1945 | France | 70/233 |

*Primary Examiner*—Kenneth J. Dorner
*Assistant Examiner*—Lloyd A. Gall
*Attorney, Agent, or Firm*—George H. Gerstman

[57] ABSTRACT

A portable security box is provided comprising a container formed from a pair of mating sections and a lock carried by one of the sections and having a flexible cable extending therefrom. The other section defines an opening for accessing the lock when both sections are in a closed position. The other section also defines a pair of openings which align with openings in the first section when the sections are in the closed position. In this manner, the cable can extend from the lock carried by the one section, through the aligned openings, and back to the lock, to secure the sections in the closed position. The container is formed from a pair of plastic sections which are hinged together at an end opposite the end at which the lock is located.

6 Claims, 3 Drawing Figures

FIG. 1
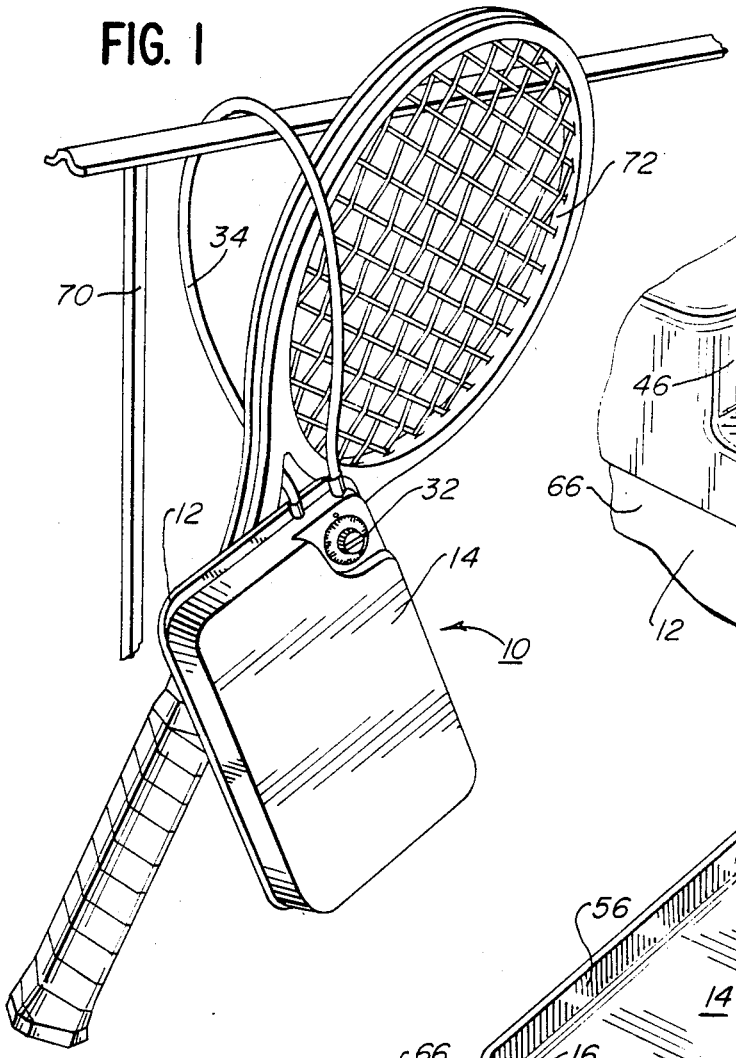
FIG. 3
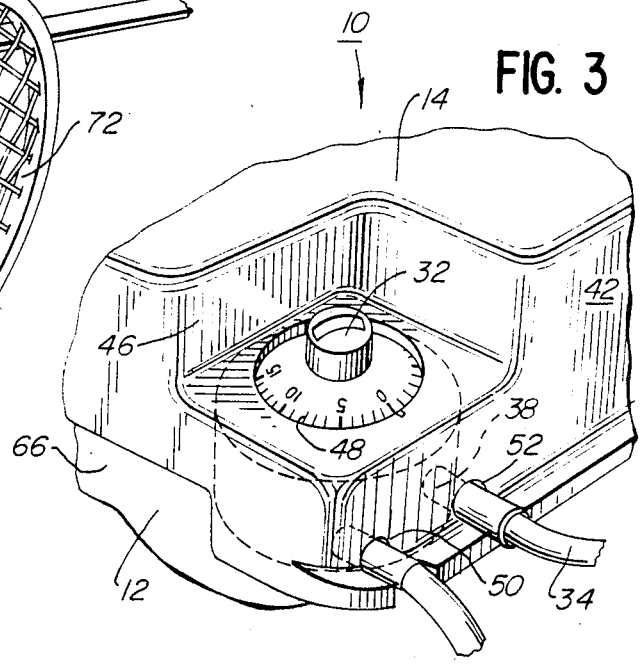
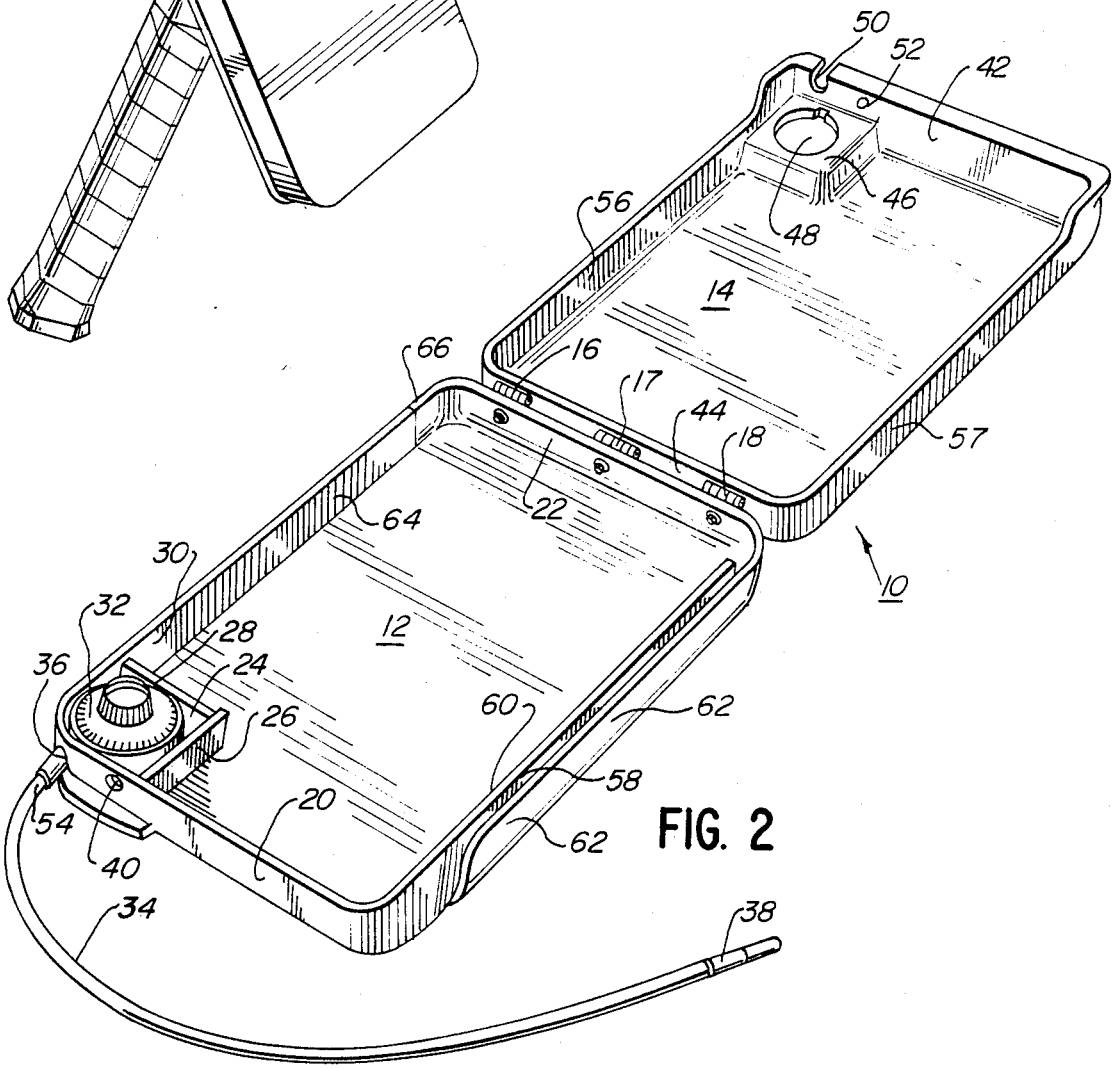
FIG. 2

PORTABLE SECURITY BOX

BACKGROUND OF THE INVENTION

The present invention concerns a novel security box that is portable and relatively inexpensive.

Portable security boxes are various shapes and have various types of locks and are well-known in the art. One type that has been advertised substantially is in the form of a hanger and comprises two mating pieces that are hinged together, with a rigid U-shaped connecting member adapted for coupling the hanger device to a closet pole.

I have found that it is often desirable to have a container that can contain valuable items, with the container having the ability to be connected to various types of devices and to secure various types of devices to the container. To this end, I have invented a portable security box that can hold a number of valuable objects, can be connected to substantially any immovable object and can also be used to immobilize other items. For example, my novel security box can be used to contain valuable items, can be connected to a bed frame, and can immobilize a tennis racket and/or an attache case.

It is, therefore, an object of the present invention to provide a portable security box that is simple in construction and effective in operation.

Another object of the present invention is to provide a portable security box that is efficient to manufacture.

Further object of the present invention is to provide a portable security box that has the ability to contain valuable items and also has the ability to immobilize other items.

Other objects and advantages of the present invention will become apparent as the description proceeds.

SUMMARY OF THE INVENTION

In accordance with the present invention, a portable security box is provided. The box comprises a container formed from a pair of mating sections. A lock is carrried by one of the sections with the lock having a flexible cable extending therefrom. The lock has means for receiving the distal end of the cable in a locked arrangement.

The other section defines means for accessing the lock when both sections are in a closed position. The other section also defines a cable opening for receiving the cable. In this manner, the cable can extend from the lock carried by the one section, through the cable opening defined by the other section, and back to the lock, to secure the sections in the closed position.

In the illustrative embodiment, the container is formed from a pair of sections formed of a plastic material and hinged together at an end opposite the end at which the lock is located. The one section includes a pocket for receiving the lock and the lock accessing means comprises an opening defined by the other section which opening overlies the lock when both sections are in a closed position.

In the illustrative embodiment, the one section defines a first opening through which the portion of the cable that is proximal the lock extends and a second opening through which the distal portion of the cable extends. The second opening is aligned with the cable opening defined by the other section when the sections are in their closed position.

In the illutrative embodiment, the lock is a combination padlock and the cable is formed of twisted steel wires. The lock accessing means also includes a recessed portion which fits into the pocket when the sections are in the closed position, with the recessed portion defining the opening for accessing the lock.

A more detailed explanation of the invention is provided in the following description and claims, and is illutrated in the accompanying drawings.

BRIEF DESCRIPTION OF THE DRAWINGS

FIG. 1 is a perspective view of a portable security box constructed in accordance with the principles of the present invention;

FIG. 2 is a perspective view of the portable security box of FIG. 1, with the sections in their open position to show the location of the elements of the box; and FIG. 3 is an enlarged view of the lock area of the portable security box of FIGS. 1 and 2.

DETAILED DESCRIPTION OF THE ILLUSTRATIVE EMBODIMENT

Referring to the drawings, a portable security box 10 is shown therein comprising a first or bottom section 12 and second or top section 14. Sections 12 and 14 are generally rectilinear and formed of a strong plastic material, preferably injected molded Lexan. Alternatively, the plastic material could by Nylon 66, Delrin 500, ABS, or other suitable strong plastic materials.

Sections 12 and 14 are hinged together by means of appropriate steel hinges 16, 17 and 18. At end 20 of section 12, which is oppoite to hinged end 22 of section 12, there is a pocket 24 defined by walls 26, 28 which are perpendicular to each other and are perpendicular to end 20 and side 30, respectively. Within pocket 24 there is a stainless steel, pick-proof combination padlock 32 having an 18-inch multi-twisted steel wires cable 34 extending therefrom, with cable 34 having a vinyl tubing cover. Cable 34 extends through a first opening 36 defined by end 20. The distal end 38 of cable 34 can return to lock 32 through a second opening 40 defined by end wall 20 and being spaced from first opening 36 to enable distal end 38 to extend through second opening 40 and back into lock 32.

At end 42 of section 14, which is opposite hinged end 44 of section 14, there is a recessed portion 46 which is dimensioned to fit within pocket 24 and which defines an opening 48 enabling access to combination lock 32, as shown in most detail in FIG. 3. At end 42 there is defined a slot 50 and an opening 52. Slot 50 aligns with first opening 36 when sections 12 and 14 are closed and opening 52 aligns with second opening 40 when sections 12 and 14 are closed. It can be seen that cable 34 extends from lock 32 and through first opening 36. When sections 12 and 14 are closed, slot 50 will encircle proximal portion 54 of cable 34 and distal portion 38 can be extended through opening 52 and second opening 40 back into lock 32, to secure sections 12 and 14 together. Referring to FIG. 2, it can be seen that side walls 56, 57 of section 14 are spaced so as to allow side wall 57 to fit within slot 58 which is defined by first side wall 60 of section 12 and second side wall 62. Likewise, side wall 56 fits within a similar groove defined by inner side wall 64 of section 12 and outer side wall 66 of section 12.

One of the most effective features of the present invention is that it can be connected to substantially any immovable object and can connect other objects thereto. Referring to FIG. 1, for example, it is seen that security box 10, containing valuable small items, is locked closed and is looped around a bed frame 70 and through a tennis racket 72, thereby securing both the tennis racket and the security box to the bed frame 70. This security box is usually for persons who are traveling who do not want to place certain valuables within a hotel deposit box, for athletes who do not want to carry bulky wallets or keys and can secure these items to a fence, etc., for students who can secure items to their school desk, and numerous other uses.

Although an illustrative embodiment of the invention has been shown and described, it is to be understood that various modifications and substitutions may be made by those skilled in the art without departing from the novel spirit and scope of the present invention.

What is claimed is:

1. A portable security box which comprises:

a container that can be moved from place to place comprising a separate, unattached unit formed from a pair of hinged mating sections, each section comprising a portion of the box which, when mated with the other section, form a closed box having an inaccessible interior;

a lock carried by one of the sections and having an elongated high strength member extending therefrom;

said one section including means for receiving the lock and said other section defining an opening which overlies the lock that is received by said one section, with said lock being located interior of said box when both sections are in a closed position but being accessible from exterior of the box;

said other section also defining a member opening for receiving said member whereby said member can extend from the lock carried by said one section, through the member opening defined by the other section and back to the lock, to secure the sections in the closed position.

2. A portable security box as described in claim 1, said container being formed from a pair of sections formed of a plastic material, and said lock receiving means comprising a pocket for receiving the lock.

3. A portable security box as described in claim 1, said one section defining a first opening through which the portion of the member that is proximal the lock extends and a second opening through which the distal portion of the cable extends, said second opening being aligned with said member opening defined by the other section, when both sections are in a closed position.

4. A portable security box as described in claim 1, wherein said lock is a combination padlock and said member is formed of twisted steel wires;

5. A portable security box which comprises:

a container that can be moved from place to place comprising a separate, unattached unit, formed from a pair of mating sections;

a lock carried by one of the sections and having an elongated high strength member extending therefrom, said lock having means for receiving the distal end of said member in a locked arrangement;

said one section including a pocket for receiving said lock;

the other section including a recessed portion which extends into said pocket when the sections are in a closed position, said recessed portion defining an opening for accessing said lock when both sections are in the closed position;

said other section also defining a member opening for receiving said member;

said one section defining a first opening through which the portion of said member that is proximal the lock extends and a second opening through which the distal portion of said member extends, said second opening being aligned with said member opening defined by the other section, whereby said member can extend from the lock carried by said one section, through the first opening, through the member opening defined by the other section, through the second opening, and back to the lock, to secure the sections in the closed position;

said container being formed from said pair of sections formed of a plastic material and hinged together at an end opposite the end at which the lock is located, each section comprising a portion of the container which, when mated with the other section, forms a closed container having an inaccessible interior.

6. A portable security box as decribed in claim 5, wherein said lock is a combination padlock and said member is a cable formed of twisted steel wires, said container having a generally rectilinear configuration and said other section defining a slot which aligns with said first opening when the sections are in the closed position.

* * * * *